US009683337B2

(12) United States Patent
Ellwein et al.

(10) Patent No.: US 9,683,337 B2
(45) Date of Patent: Jun. 20, 2017

(54) PAVING MACHINE SCREED ASSEMBLY WITH MATERIAL BYPASS PREVENTION PLATE

(71) Applicant: Caterpillar Paving Products Inc., Brooklyn Park, MN (US)

(72) Inventors: Jacob Ellwein, Oak Grove, MN (US); Tobin D. Rasmusson, Bloomington, MN (US); Luke E. Graham, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 22 days.

(21) Appl. No.: 14/642,239

(22) Filed: Mar. 9, 2015

(65) Prior Publication Data

US 2016/0265173 A1 Sep. 15, 2016

(51) Int. Cl.
*E01C 19/00* (2006.01)
*E01C 19/48* (2006.01)

(52) U.S. Cl.
CPC ..... *E01C 19/4873* (2013.01); *E01C 2301/16* (2013.01)

(58) Field of Classification Search
CPC ..... E01C 19/18; E01C 19/22; E01C 19/42; E01C 19/46; E01C 19/4873; E01C 2301/16
USPC ..... 14/75, 84.05, 101, 118; 404/75, 84.05, 404/101, 118, 104
See application file for complete search history.

(56) References Cited

U.S. PATENT DOCUMENTS

| | | | |
|---|---|---|---|
| 5,203,642 A | 4/1993 | Heller et al. | |
| 5,397,199 A | 3/1995 | Frampton et al. | |
| 5,568,992 A | 10/1996 | Grembowicz et al. | |
| 6,106,192 A | 8/2000 | Hargis et al. | |
| 6,238,135 B1 | 5/2001 | Rower | |
| 8,657,527 B2 | 2/2014 | Angermann | |
| 2016/0122954 A1* | 5/2016 | Comer | E01C 19/48 404/118 |

FOREIGN PATENT DOCUMENTS

| | | |
|---|---|---|
| CN | 102383363 A | 3/2012 |
| WO | 201367869 A1 | 5/2013 |

* cited by examiner

*Primary Examiner* — Raymond W Addie
(74) *Attorney, Agent, or Firm* — Miller, Matthias & Hull

(57) ABSTRACT

A screed assembly for a paving machine may comprise a main screed and an extension screed configured to extend from the main screed to a fully-extended position. The extension screed may include a deflector and a material bypass prevention plate affixed to the extension screed. The material bypass prevention plate may have a projection that extends into and fills a space between the material bypass prevention plate and the main screed when the extension screed is in the fully-extended position.

20 Claims, 7 Drawing Sheets

PAVING MACHINE SCREED ASSEMBLY WITH MATERIAL BYPASS PREVENTION PLATE

TECHNICAL FIELD

The present disclosure generally relates to screed assemblies for paving machines, and more specifically, to systems and methods for preventing paving material leakage between main screeds and extension screeds when the extension screeds are fully-extended.

BACKGROUND

Paving machines are used to lay and level a paving material, such as asphalt, on a ground surface for the construction of roads, bridges, parking lots, and other such surfaces. In general, paving machines include a chassis, a hopper for storing the paving material, an auger that distributes the paving material on a ground surface, and a screed assembly that compacts/levels the paving material to a desired mat thickness. The screed assembly may be rear-mounted on the paving machine behind the hopper, the chassis, and the auger relative to the direction of travel. The screed assembly may include a main screed and one or more extension screeds mounted behind (or in front of) the main screed. The extension screeds are laterally extendable from the main screed to adjust for varying ground surface widths. In addition, the main screed and the extension screeds may each include a bottom-facing screed plate that compacts the paving material on the ground surface at a pre-determined "angle of attack". Some screed assembly designs may also include a tamper bar at the front of the main and/or extension screeds that move up and down vertically to pre-compact the paving material in front of the main and/or extension screeds.

While effective, uncompacted paving material may be prone to leak through a gap between the main screed and the extension screeds, when the extension screeds are fully-extended. This may ultimately lead to undesirable streaks of uncompacted paving material that trail behind the paving machine. This problem may be more prevalent with screed assembly designs having tamper bars because the tamper bars may push the paving material forward, causing it to bypass other systems designed to block paving material leakage between the main and extension screeds.

U.S. Pat. No. 6,106,192 addresses the problem of mat streaking in paving machines caused by overlapping edges of front-mounted extendible screeds a rear-mounted central main screed. In this case, the streaks are formed from compacted material that is more densely compressed and shinier than the rest of the mat. To prevent the formation of the shiny streaks, a flow-modifying device is disclosed that plows the paving material at the outer edges of the main screed toward the central axis of the main screed. However, the flow-modifying device disclosed therein does not address or correct the problem of streaks of uncompacted material caused by paving material leakage through gaps between the main and extension screeds. Moreover, the flow-modifying device is specifically designed for paving machines having front-mounted (not rear-mounted) extendible screeds.

There is a need for screed assembly designs that prevent the leakage of paving material between the main screed and rear-mounted extension screeds when the extension screeds are fully-extended.

SUMMARY

In accordance with one aspect of the present disclosure, a screed assembly for a paving machine is disclosed. The screed assembly may comprise a main screed and an extension screed configured to extend from the main screed to a fully-extended position. The extension screed and the main screed may define a gap therebetween when the extension screed is in the fully-extended position. The extension screed may include a deflector and a material bypass prevention plate affixed to the extension screed. The material bypass prevention plate may have a projection that extends into and fills a space between the material bypass prevention plate and the main screed when the extension screed is in the fully-extended.

In accordance with another aspect of the present disclosure, a paving machine is disclosed. The paving machine may be configured to pave a paving material on a ground surface and may comprise a chassis, a hopper configured to carry the paving material, and a distributing device configured to distribute the paving material on the ground surface. The paving machine may further comprise a screed assembly that may include a main screed and an extension screed configured to extend from the main screed to a fully-extended position. The extension screed may include a deflector and a material bypass prevention plate affixed to the extension screed. The material bypass prevention plate may have a projection that extends into and fills a space between the material bypass prevention plate and the main screed when the extension screed is in the fully-extended position.

In accordance with another aspect of the present disclosure, a method for preventing a paving material from leaking through a gap between a main screed and an extension screed of a screed assembly when the extension screed is in a fully-extended position is disclosed. The extension screed may be axially aft of the main screed and may have a tamper bar. The method may comprise attaching a material bypass prevention plate to the extension screed such that a projection of the material bypass prevention plate extends into and fills a space between the material bypass prevention plate and the main screed, and such that a chamfer on an aft-facing edge of the projection is axially forward of and contours the tamper bar. The method may further comprise allowing a portion of the paving material to flow to toward the gap and between the tamper bar and the aft-facing edge, and using the chamfer to prevent compaction of the portion of the paving material between the tamper bar and the aft-facing edge. The method may further comprise redirecting the portion of the paving material between the tamper bar and the aft-facing edge to a front of the extension screed with the chamfer, and paving the portion of the paving material with the extension screed.

These and other aspects and features of the present disclosure will be more readily understood when read in conjunction with the accompanying drawings.

DETAILED DESCRIPTION

Figure 1:
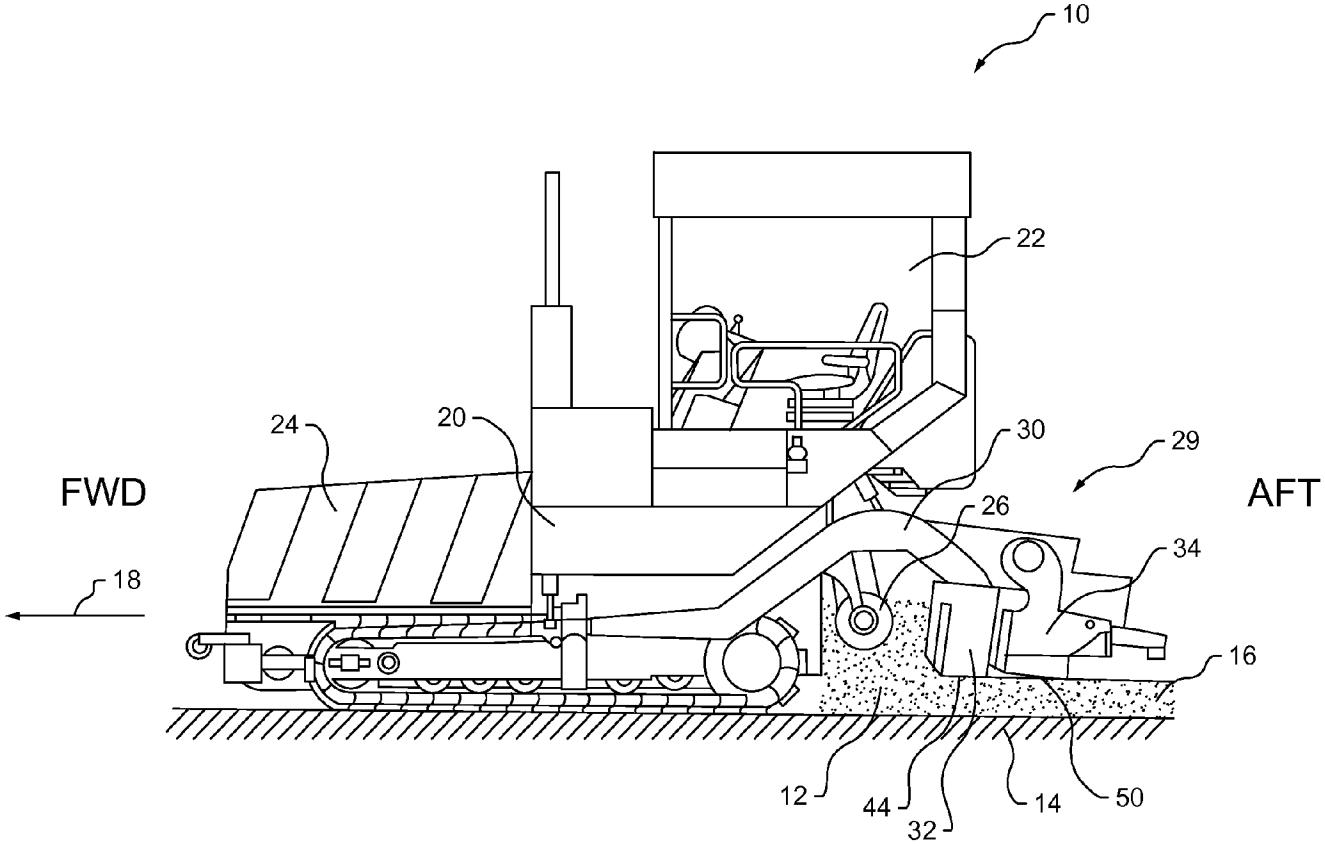
FIG. 1 is a side view of a paving machine having a screed assembly, constructed in accordance with the present disclosure.

Referring now to the drawings, and with specific reference to FIG. 1, a paving machine 10 is depicted. The paving machine 10 is used to level and compact a paving material 12, such as hot mix asphalt, on a ground surface 14 to provide a mat 16 of paved material. As used herein, a "forward" position refers to positions that are forwardly-located on the paving machine 10 with respect to a direction of travel 18 of the paving machine, while an "aft" position refers to positions that are rearwardly-located on the paving machine 10 with respect to the direction of travel 18. The paving machine 10 generally includes a chassis 20, which may have a track-style traveling mechanism (shown) or may be on wheels, as well as a passenger cab 22 mounted on the chassis 20. In addition, it further includes a hopper 24 mounted near the forward end of the paving machine 10 that stores the paving material 12, as well as a distributing device 26, such as an auger, that distributes the paving material 12 on the ground surface 14. Furthermore, the paving machine 10 also includes a screed assembly 29 that is configured to level and compact the paving material 12 on the ground surface 14. The screed assembly 29 is mounted on the aft side of the paving machine 10 behind the distributing device 26 via one or more arms 30, as shown. As explained in further detail below, the screed assembly 29 includes a main screed 32 and one or more extension screeds 34 that extend laterally from the main screed 32 with respect to a central axis 35 of the screed assembly 29 (see FIG. 2). As will be explained in further detail below, the present disclosure addresses the problem of uncompacted paving material leakage between main and extension screeds when the extension screeds are fully-extended, particularly in screed assembly designs having tamper bars.

Figure 2:
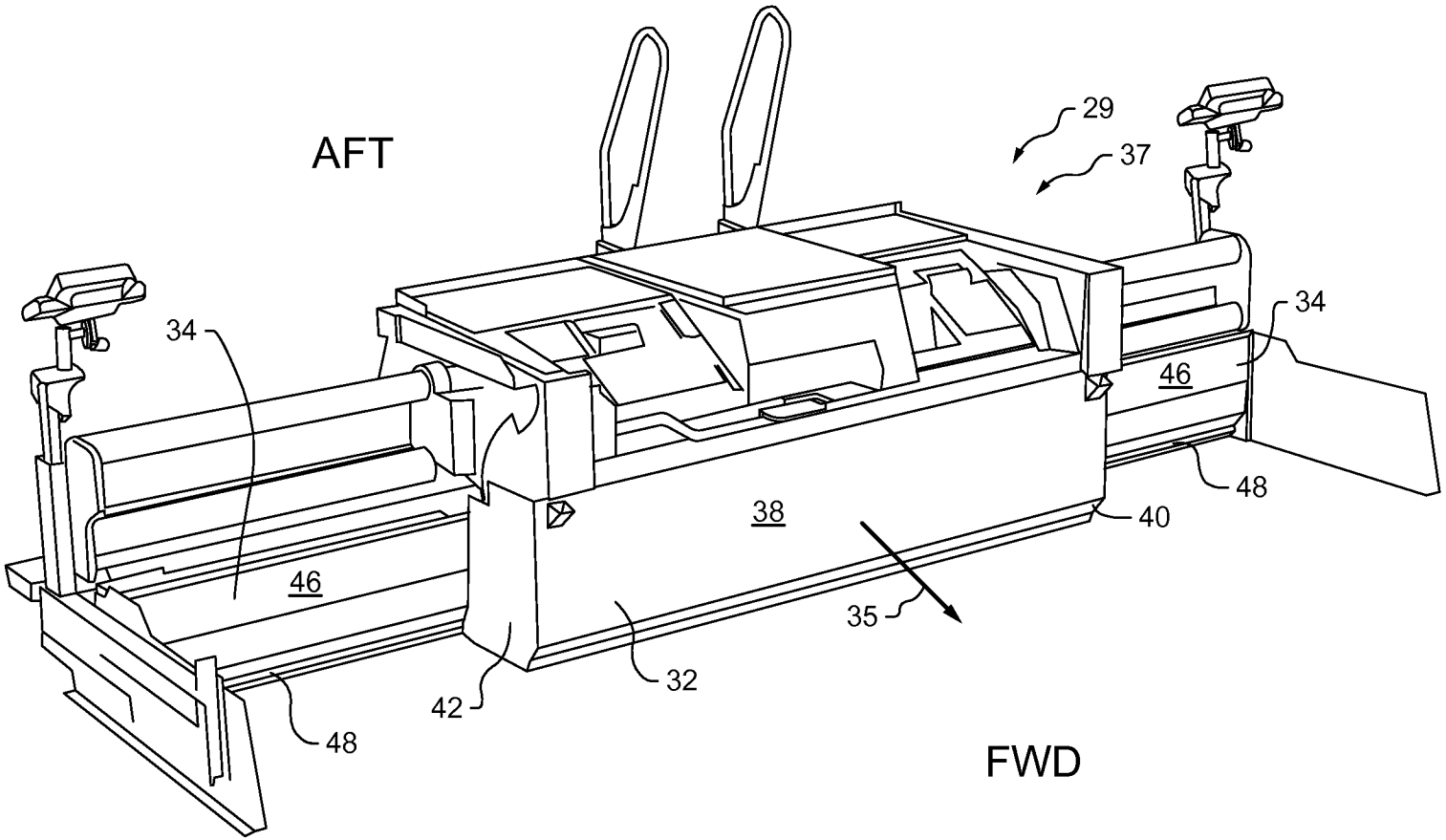
FIG. 2 is a front perspective view of the screed assembly of FIG. 1 shown in isolation, constructed in accordance with the present disclosure.

Turning now to FIG. 2, the screed assembly 29 is shown in more detail. In the depicted arrangement, the main screed 32 is centrally located, and the extension screeds 34 are movably connected to the main screed 32 with one extension screed 34 on each lateral side of the main screed 32. However, other possible arrangements may include a single extension screed or more than two extension screeds. In any event, the extension screeds 34 are laterally extendable with respect to the main screed 32/central axis 35 to adjust for variations in the width of the ground surface 14. Using an actuating mechanism (e.g., hydraulic cylinders, etc.), the extension screeds 34 are translated laterally inward toward the central axis 35 to a fully-retracted position (not shown), and laterally outward away from the central axis 35 to a fully-extended position 37 with a range of intermediate positions in between. In addition, the extension screeds 34 may be positioned axially aft of the main screed 32, as shown.

The main screed 32 includes a generally vertically-extending deflector 38, and may also include a tamper bar 40 disposed near a bottom edge of the deflector 38 that moves up and down vertically to pre-compact the paving material 12 in front of the main screed 32. In addition, the main screed 32 has side plates 42 mounted on the laterally outward-facing sides of the main screed 32 and oriented perpendicular to the deflector 38, as well as a generally downward-facing (i.e., towards the ground surface 14) and horizontally-extending main screed plate 44 that may contact and compact the paving material 12 at a set "angle of attack" (i.e., the angle that the screed plate 44 makes with the ground surface 14) as will be understood by those with ordinary skill in the art of paving machines (see FIGS. 1 and 5). As used herein, a laterally inward-facing side or surface faces laterally toward the central axis 35 of the screed assembly 29, and a laterally outward-facing side or surface faces laterally away from the central axis 35.

Likewise, each of the extension screeds 34 include a generally vertically-extending deflector 46, and may also include a tamper bar 48 along a bottom edge of the deflector 46 that may move up and down to pre-compact the paving material 12 in front of the extension screed 34. In addition, each of the extension screeds 34 include a generally downward-facing and horizontally-extending extension screed plate 50 that contacts and compacts the paving material 12 at a set angle of attack (see FIGS. 1 and 5). In addition, as will be understood by those skilled in the art, the extension screeds 34 are vertically adjustable with respect to the main screed 32 to adjust paving uniformity.

Figure 3:
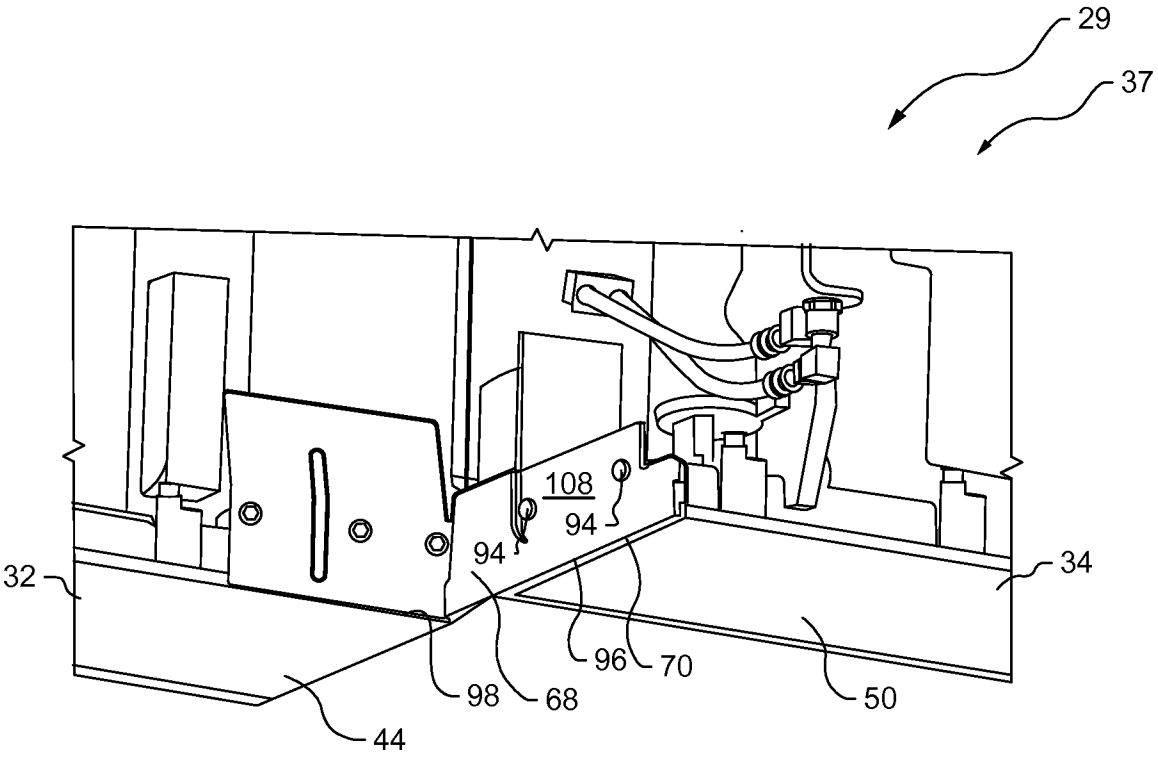
FIG. 3 is an aft perspective view of a portion of the screed assembly of FIG. 2, illustrating a material bypass prevention plate affixed to an extension screed, constructed in accordance with the present disclosure.
Figure 5:
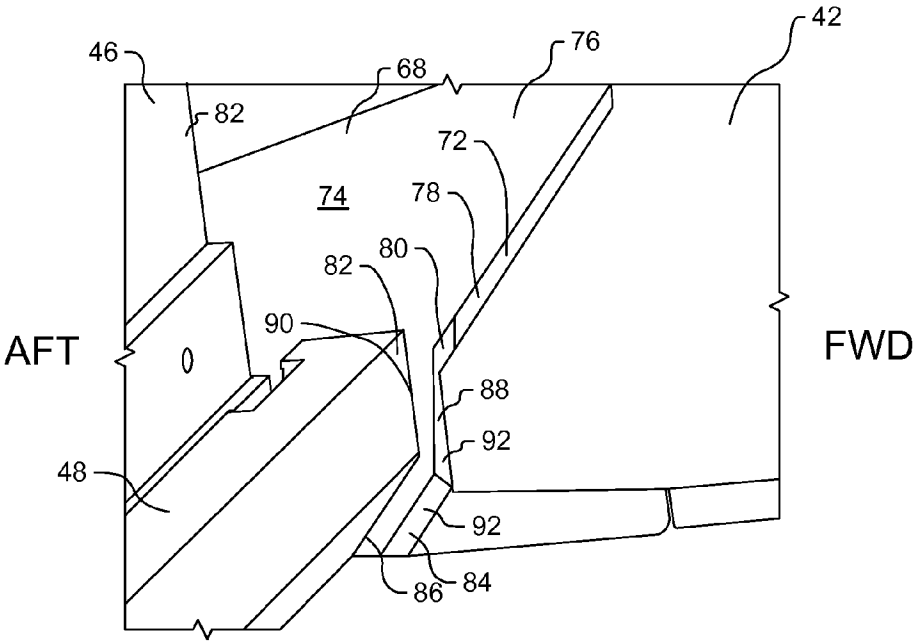
FIG. 5 is an enlarged view of detail 5 of FIG. 4, constructed in accordance with the present disclosure.
Figure 4:
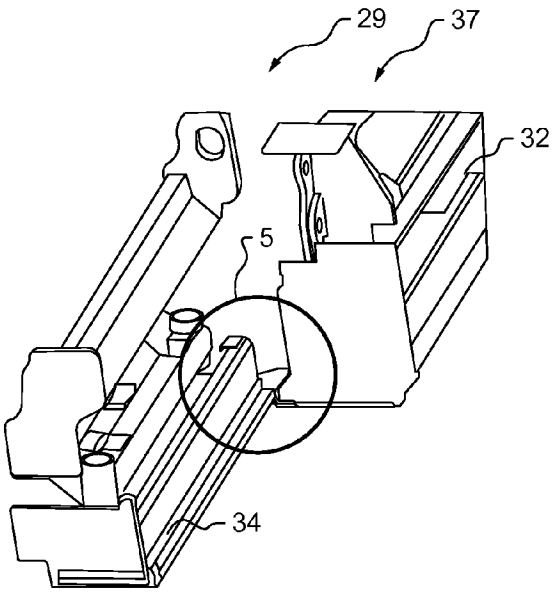
FIG. 4 is side perspective view of the portion of the screed assembly of FIG. 3 with the extension screed in a fully-extended position, constructed in accordance with the present disclosure.

Referring now to FIGS. 3-5, the screed assembly 29 of the present disclosure includes a material bypass prevention plate 68 affixed to each of the extension screeds 34. When the extension screeds 34 are in the fully-extended position 37, the material bypass prevention plate 68 is configured to prevent the leakage of uncompacted paving material between the main screed 32 and the extension screeds 34. Specifically, the material bypass at least partially blocks a gap between the main screed 32 and the extension screeds 34 when the extension screeds 34 are in the fully-extended position 37 and prevents uncompacted paving material from leaking therethrough. The material bypass prevention plate 68 is affixed to a laterally inward-facing side 70 of the extension screed 34 such that the plate 68 extends vertically and is oriented perpendicular to the deflector 46. If the screed assembly 29 includes a plurality of extension screeds 34, a material bypass prevention plate 68 is affixed to each of the extension screeds as shown in FIG. 3.

In addition, the material bypass prevention plate 68 includes a projection 72 extending from a laterally outward-facing surface 74 of the plate 68 (see FIG. 5). When the extension screeds 34 are in the fully-extended position 37, a forward end 76 of the plate 68 overlaps a laterally inward-facing surface of the side plate 42, with the projection 72 at least partially extending into a space between the plate 68 and the side plate 42 (see FIG. 7). In one aspect of the present disclosure, the projection 72 completely fills the space between the plate 68 and the side plate 42 to prevent paving material from being pushed forward and around the plate 68 by the movement of the tamper bar 48.

Figure 6:
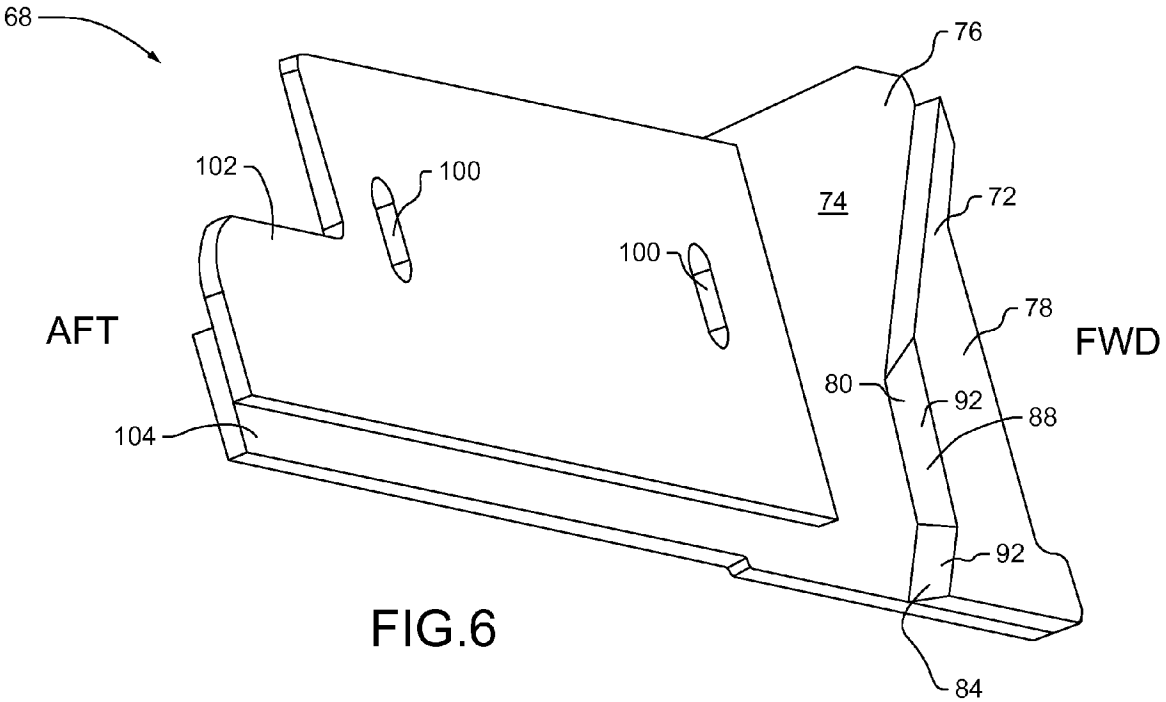
FIG. 6 is a side perspective view of the material bypass prevention plate shown in isolation, constructed in accordance with the present disclosure.

In one aspect of the present disclosure, the projection 72 is a second plate 78 affixed to the forward end 76 of the laterally outward-facing surface 74 of the plate 68 (also see FIG. 6). The second plate 78 includes an aft-facing edge 80 that is axially forward of and generally contours laterally inward edges 82 of the deflector 46 and the tamper bar 48, as best shown in FIG. 5. More specifically, the aft-facing edge 80 includes a first surface 84 that contours an angled first surface 86 of the tamper bar 48 that is involved in pre-compacting the paving material, as well as a second surface 88 that contours a vertically-extending second surface 90 of the tamper bar 48. Notably, the first surface 84 and the second surface 88 of the aft-facing edge 80 each include a chamfer 92 in which the surfaces 84 and 88 are offset from a perpendicular angle with respect to the laterally outward-facing surface 74 of the plate 68. Stated in another way, the surfaces 84 and 88 are offset from a parallel angle with respect to the surfaces 86 and 90 of the tamper bar 48, respectively. Specifically, the surfaces 84 and 88 slope in a forward direction from the laterally outward-facing surface 74 of the plate, with the first surface 84 angled downward toward the ground surface 14. The angled surfaces 84 and 88 of the chamfers 92 may advantageously redirect any paving material 12 that flows between the tamper bar 48 and the aft-facing surface 80 to the front of the extension screed 34 where it may then be paved under the extension screed 34.

In contrast, in the absence of a chamfer at the first surface 84 and the second surface 88 (i.e., with the surfaces 84 and 88 oriented parallel to the surfaces 86 and 90 of the tamper bar), paving material could become compacted between the tamper bar 48 and the surfaces 84 and 88, potentially causing sticking or dragging of clumps of compacted material that could leave marks or other inhomogeneities in the mat 16. Thus, the chamfers 92 prevent the compaction of paving material between the tamper bar 48 and the aft-facing edge 80 of the projection 72, and are configured to channel any paving material that flows between the tamper bar 48 and the aft-facing edge 80 to the front of the extension screed 34 for paving.

The material bypass prevention plate 68 is affixed to the extension screed 34 using fasteners, such as bolts 94 (see FIG. 3). Alternatively, the plate 68 may be welded to the extension screed 34 or it may be integrally formed with the extension screed 34. In addition, the vertical position of the material bypass prevention plate 68 is manually adjusted as needed such that a bottom edge 96 of the plate 68 is vertically aligned with a trailing edge 98 of the main screed plate 44 regardless of the vertical position of the extension screed 34. In this regard, the plate 68 include vertically-extending slots 100 that receive bolts 94 and allow the manual adjustment of the position of the plate 68 with respect to the extension screed 34 and the main screed 32 (see FIG. 6).

Figure 7:
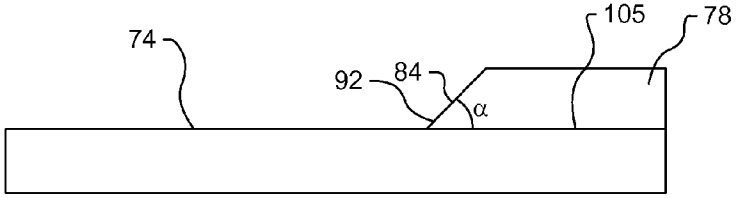
FIG. 7 is a bottom view of the material bypass prevention plate, constructed in accordance with the present disclosure.
Figure 8:
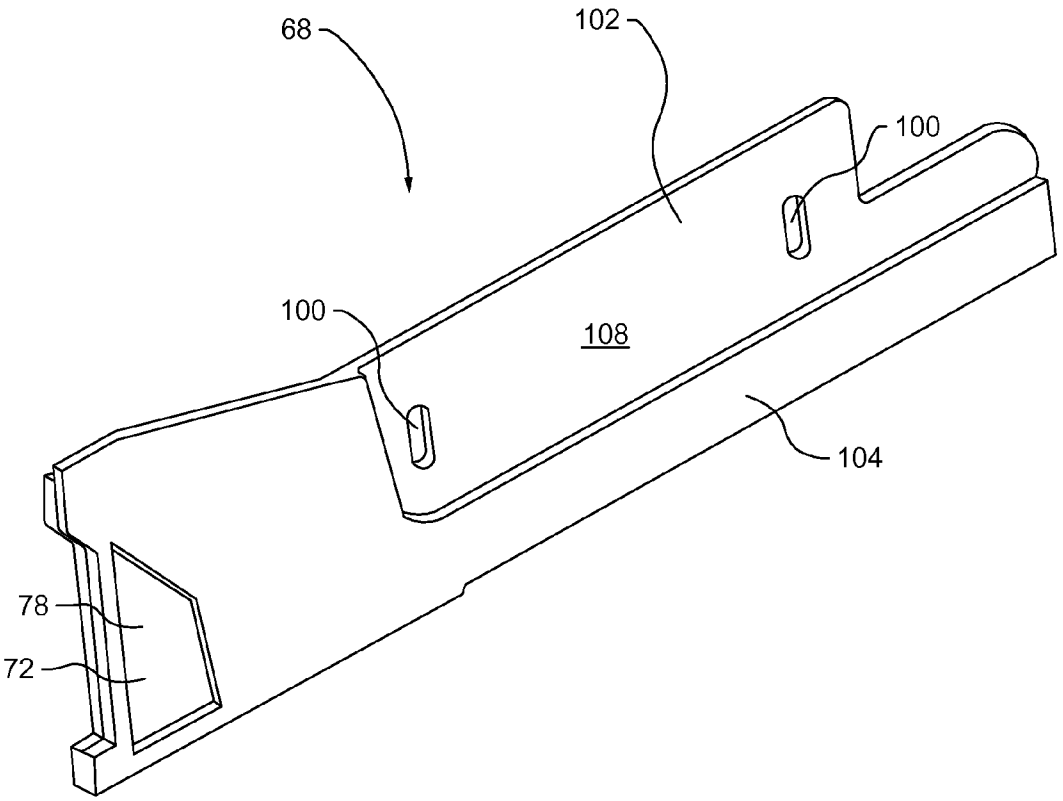
FIG. 8 is another side perspective view of the material bypass prevention plate, constructed in accordance with the present disclosure.

Turning now to FIGS. 6-8, the material bypass prevention plate 68 is shown in isolation. As a non-limiting possibility, the plate 68 consists of two separate plate units 102 and 104 welded or otherwise joined together in a vertically offset arrangement, as shown. In addition, the second plate 78 is affixed to the laterally outward-facing surface 74 of the plate 68 by welding or another suitable joining method. As explained above, the surfaces 84 and 88 of the aft-facing edge 80 are angled with respect to the laterally outward-facing surface 74 to create chamfers 92. As one possibility, the surfaces 84 and 88 are oriented at an angle ($\alpha$) of about 45° with respect to a laterally inward-facing surface 105 of the second plate 78, as best shown in FIG. 7. However, other chamfer angles may certainly be used depending on variations in the design of the screed assembly 29.

The plate 68 also includes a laterally inward-facing surface 108 through which bolts 94 are inserted if the plate is affixed to the extension screed with fasteners (see FIGS. 3 and 8). Specifically, the bolts 94 are inserted through the vertically-extending slots 100 and into appropriate receivers provided on the laterally inward-facing side 70 of the extension screed 34 to both affix the plate 68 to the extension screed 34 as well as to set the vertical position of the plate 68.

Figure 9:
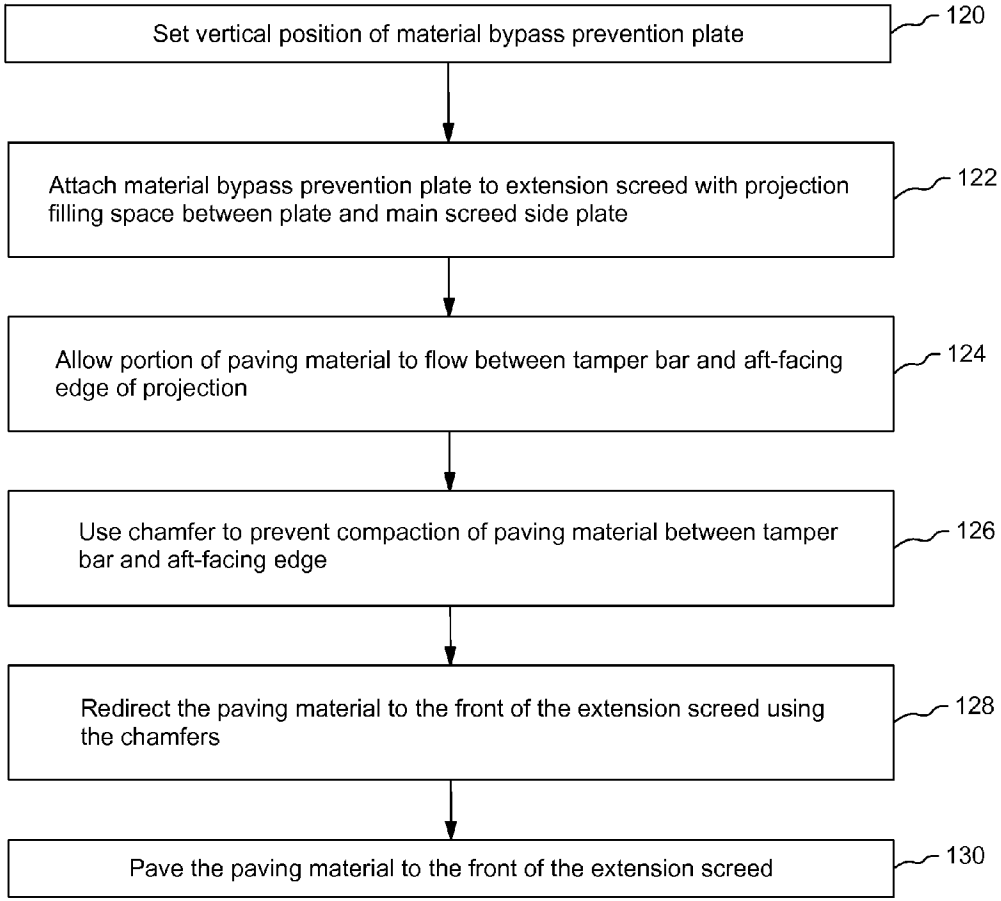
FIG. 9 is a flowchart depicting a series of steps that may be involved in using the material bypass prevention plate to prevent paving material leakage between the main screed and the extension screed when the extension screed is in the fully-extended position, in accordance with a method of the present disclosure.

A series of steps involved in using the material bypass prevention plate 68 to prevent the leakage of the paving material 12 between the main screed 32 and the extension screed 34 when the extension screed 34 is in the fully-extended position 37 is shown in FIG. 9. Beginning with a first block 120, the vertical position of the material bypass prevention plate 68 is adjusted with respect to the extension screed 34 and the main screed 32 such that the bottom edge 96 of the plate 68 is vertically aligned with the trailing edge 98 of the main screed 32 even if the extension screed 34 is elevated with respect to the main screed 32. In addition, the aft-facing edge 80 of the projection 72 is positioned axially forward of the laterally inward edges 82 of the deflector 46 and the tamper bar 48 of the extension screed 34 such that the aft-facing edge 80 contours the laterally inward-facing edges 82 of the deflector 46 and the tamper bar 48. According to a next block 122, the plate 68 is affixed to the laterally inward-facing side 70 of the extension screed 34 such that the plate 68 blocks the gap between the main screed 32 and the extension screed 34, and the projection 72 extends into and fills the space between the plate 68 and the main screed side plate 42. As explained above, the plate 68 may be attached to the extension screed 34 using fasteners (e.g., bolts 94), by welding, or by another suitable method.

As the paving machine 10 travels in the forward direction, a portion of the paving material 12 is permitted to flow between the tamper bar 48 and the aft-facing edge 80 of the projection 72 according to a next block 124. The chamfers 92 on the aft-facing edge 80 are then used to prevent compaction of the paving material 12 between the tamper bar 48 and the aft-facing edge 80 of the projection 72 as explained above (block 126). Further, the chamfers 92 may advantageously redirect the paving material between the tamper bar 48 and the projection 72 toward the front of the extension screed 34 (block 128). Once redirected to the front of the extension screed 34, the paving material 12 is pre-compacted with the tamper bar 48 and paved under the extension screed plate 50 according to a next block 130.

INDUSTRIAL APPLICABILITY

The teachings of the present disclosure are beneficial to paving machines, and more particularly to paving machines having extension screeds. The material bypass prevention plate disclosed herein is affixed to an extension screed of a screed assembly to prevent uncompacted paving material from leaking between the extension screed and the main screed when the extension screed is in the fully-extended position. In addition, the material bypass prevention plate has a laterally-outward extending projection that extends into and fills a space between the material bypass prevention plate and the main screed side plate to further prevent the paving material from being pushed forward and around the material bypass prevention plate by the up and down movement of the tamper bar. The aft-facing edge of the projection contours the laterally inward edge of the tamper bar, and is provided with one or more chamfers. The chamfers are configured to prevent compaction of paving material between the tamper bar and the aft-facing edge, as well as redirect the uncompacted paving material to the front of the extension screed where it may be uniformly paved under the extension screed plate with the bulk of the paving material. Thus, the material bypass prevention plate disclosed herein supports paving uniformity in paving machines with extension screeds fully-extended by blocking uncompacted paving material leakage between the main screed and the extension screed, by preventing the paving material from bypassing the plate by the forward-pushing movement of the tamper bar, by preventing compaction of paving material between the tamper bar and the aft-facing edge of the projection which could otherwise lead to inhomogenous marks on the mat, and by channeling the paving material between the tamper bar and the projection to the front of the extension screed. It is also noted that the teachings of the present disclosure may also be applicable to paving machines having extension screeds that are bolted onto the screed assembly to provide greater paving widths.

What is claimed is:

1. A screed assembly for a paving machine, comprising:
a main screed;
an extension screed configured to extend from the main screed to a fully-extended position, the extension screed including
a deflector, and
a material bypass prevention plate affixed to the extension screed, the material bypass prevention plate having a projection that extends into and fills a space between the material bypass prevention plate and the main screed when the extension screed is in the fully-extended position.

2. The screed assembly of claim 1, wherein the extension screed further includes a tamper bar.

3. The screed assembly of claim 2, wherein the main screed includes a side plate, and wherein the projection fills a space between the material bypass prevention plate and the side plate to prevent the leakage of paving material therethrough.

4. The screed assembly of claim 3, wherein the side plate is on a laterally outward-facing side of the main screed, and wherein the material bypass prevention plate is affixed to a laterally inward-facing side of the extension screed.

5. The screed assembly of claim 4, wherein the extension screed is positioned axially aft of the main screed, and wherein the extension screed is configured to extend laterally outward from the main screed to the fully-extended position.

6. The screed assembly of claim 5, wherein the projection projects laterally outward from a laterally outward-facing surface of the material bypass prevention plate.

7. The screed assembly of claim 6, wherein the projection is a second plate affixed to the laterally outward-facing surface of the material bypass prevention plate.

8. The screed assembly of claim 7, wherein the second plate includes an aft-facing edge positioned axially forward of and contouring a laterally inward edge of the tamper bar when the extension screed is in the fully-extended position.

9. The screed assembly of claim 8, wherein the aft-facing edge of the second plate includes a chamfer.

10. The screed assembly of claim 9, wherein the chamfer is configured to prevent compaction of the paving material between the tamper bar and the aft-facing edge when the extension screed is in the fully-extended position, and to direct the paving material between the tamper bar and the aft-facing edge to a front of the extension screed.

11. A paving machine configured to pave a paving material on a ground surface, comprising:
a chassis;
a hopper configured to carry the paving material;
a distributing device configured to distribute the paving material on the ground surface; and
a screed assembly including a main screed and an extension screed configured to extend from the main screed to a fully-extended position, the extension screed including
a deflector, and
a material bypass prevention plate affixed to the extension screed, the material bypass prevention plate having a projection that extends into and fills a space between the material bypass prevention plate and the main screed when the extension screed is in the fully-extended position.

12. The paving machine of claim 11, wherein the extension screed further includes a tamper bar.

13. The paving machine of claim 12, wherein the main screed includes a side plate, and wherein the projection fills a space between the material bypass prevention plate and the side plate to prevent the leakage of paving material therethrough.

14. The paving machine of claim 13, wherein the side plate is on a laterally outward facing side of the main screed, and wherein the material bypass prevention plate is affixed to a laterally inward-facing side of the extension screed.

15. The paving machine of claim 14, wherein the extension screed is positioned axially aft of the main screed, and wherein the extension screed is configured to extend laterally outward from the main screed to the fully-extended position.

16. The paving machine of claim 15, wherein the projection projects laterally outward from a laterally outward-facing surface of the material bypass prevention plate.

17. The paving machine of claim 16, wherein the projection is a second plate affixed to the laterally outward-facing surface of the material bypass prevention plate.

18. The paving machine of claim 17, wherein the second plate includes an aft-facing edge positioned axially forward of and contouring a laterally inward edge of the tamper bar when the extension screed is in the fully-extended position.

19. The paving machine of claim 18, wherein the aft-facing edge of the second plate includes a chamfer.

20. A method for preventing a paving material from leaking between a main screed and an extension screed of a screed assembly when the extension screed is in a fully-extended position, the extension screed being axially aft of the main screed and having a tamper bar, the method comprising:
attaching a material bypass prevention plate to the extension screed such that a projection of the material bypass prevention plate extends into and fills a space between the material bypass prevention plate and the main screed, and such that a chamfer on an aft-facing edge of the projection is axially forward of and contours the tamper bar;
allowing a portion of the paving material to flow between the tamper bar and the aft-facing edge;
using the chamfer to prevent compaction of the portion of the paving material between the tamper bar and the aft-facing edge;

redirecting the portion of the paving material between the tamper bar and the aft-facing edge to a front of the extension screed with the chamfer; and paving the portion of the paving material with the extension screed.

* * * * *